US007216614B2

(12) United States Patent
Shibata et al.

(10) Patent No.: US 7,216,614 B2
(45) Date of Patent: May 15, 2007

(54) FUEL SUPPLY DEVICE FOR OUTBOARD DEVICE

(75) Inventors: Yasuhiko Shibata, Shizuoka-ken (JP); Katsumi Ochiai, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 56 days.

(21) Appl. No.: 11/228,559

(22) Filed: Sep. 16, 2005

(65) Prior Publication Data

US 2006/0107932 A1 May 25, 2006

(30) Foreign Application Priority Data

Sep. 16, 2004 (JP) ..... 2004-270021

(51) Int. Cl.
*F02M 37/04* (2006.01)
*F02B 77/08* (2006.01)

(52) U.S. Cl. ..... 123/179.17; 123/198 DB; 123/516; 123/497

(58) Field of Classification Search ..... 123/516, 123/510–511, 179.16, 179.17, 198 DB, 497
See application file for complete search history.

(56) References Cited

U.S. PATENT DOCUMENTS 3,851,633 A * 12/1974 Shih ..... 123/575
5,743,236 A * 4/1998 Kawakami ..... 123/491
5,752,488 A * 5/1998 Hattori et al. ..... 123/491
5,752,490 A * 5/1998 Rodgers et al. ..... 123/497
5,797,378 A 8/1998 Kato
6,276,340 B1 * 8/2001 Kato ..... 123/491
6,314,947 B1 * 11/2001 Roche ..... 123/525
6,318,344 B1 * 11/2001 Lucier et al. ..... 123/516
6,408,825 B1 * 6/2002 Enoki et al. ..... 123/467
6,557,509 B1 * 5/2003 Hall et al. ..... 123/179.16
6,659,076 B2 * 12/2003 Kato ..... 123/305
6,694,955 B1 * 2/2004 Griffiths et al. ..... 123/516
6,698,401 B2 * 3/2004 Suzuki et al. ..... 123/516

FOREIGN PATENT DOCUMENTS

JP 09-144617 6/1997

* cited by examiner

*Primary Examiner*—Thomas Moulis
(74) *Attorney, Agent, or Firm*—Knobbe, Martens, Olson & Bear, LLP

(57) ABSTRACT

A fuel supply device can have a low pressure fuel pump that supplies fuel to a vapor separator tank positioned adjacent to an engine from a main fuel tank disposed in a hull. An electrically operated primary fuel pump (e.g., a primer pump) and a check valve can both be positioned parallel to each other and between the main fuel tank and the low pressure fuel pump. A control device can be connected to the primary fuel pump for operating the primary fuel pump only for a preset fuel supply time when starting the engine is attempted and prior to the start of the engine.

13 Claims, 9 Drawing Sheets

FUEL SUPPLY DEVICE FOR OUTBOARD DEVICE

PRIORITY INFORMATION

This application is based on and claims priority under 35 U.S.C. §119 to Japanese Patent Application No. 2004-270021, filed on Sep. 16, 2004, the entire contents of which is hereby expressly incorporated by reference herein.

BACKGROUND OF THE INVENTIONS

1. Field of the Inventions

The present inventions relate generally to fuel supply devices for an engines, and more particularly, to fuel supply systems for outboard motors that supply fuel to a vapor separator tank positioned adjacent to an engine from a main fuel tank disposed in a hull by a low pressure fuel pump.

2. Description of the Related Art

Some of the known outboard motor designs include a vapor separator tank disposed within the upper cowling of the outboard motor. For example, Japanese Patent Document JP-A-Hei09-144617, in at least FIG. 2 thereof, discloses such an outboard motor. In this outboard motor, both a vapor separator tank and a low pressure fuel pump are positioned on a side of and adjacent to the engine, within the cowling.

The vapor separator tank accumulates fuel to be supplied to the engine, and also has a high pressure fuel pump therein. A high pressure fuel supply conduit is connected to the vapor separator tank to supply the fuel discharged from the high pressure pump to fuel injectors. Also, a high pressure fuel return conduit is connected to the fuel injectors to return the surplus of the fuel to the vapor separator tank.

The low pressure fuel pump is used to supply the fuel to the vapor separator tank from the main fuel tank in the hull of the associated boat. The low pressure fuel pump is positioned on a side of and adjacent to the engine, and is mounted on the engine via a bracket. An upstream side low pressure fuel supply conduit is coupled with a fuel suction port of the low pressure fuel pump and extends to the main fuel tank in the cowling. A downstream side low pressure fuel supply conduit is coupled with a discharge port of the low pressure fuel pump and extends to the vapor separator tank.

A manually operated primer pump and a fuel filter are situated midway of the upstream side fuel supply conduit. The primer pump is used to supply the fuel to the low pressure fuel pump from the main fuel tank.

A switching valve is placed at a fuel inlet port of the vapor separator tank, to which the downstream side low pressure fuel supply conduit is connected, to be opened or closed by a float floating in this tank. The switching valve is closed when a surface of the liquid fuel in the vapor separator tank reaches the preset maximum level. The valve is opened when the surface of the fuel falls to a level lower than the maximum level. As such, the low pressure fuel pump supplies the fuel from the main fuel tank in the hull of the boat to the vapor separator tank in the outboard motor, and the high pressure fuel pump supplies the fuel in the vapor separator tank to the fuel injectors.

SUMMARY OF THE INVENTIONS

An aspect of at least one of the embodiments disclosed herein includes the realization that an electronic fuel pump can be used to simply a starting procedure for an outboard motor. For example, occasionally, before starting a conventional outboard motor described above, an operator needs to supply fuel to the vapor separator tank from the main fuel tank using the manually operated primer pump. A so-called "dead soak," is when the operator stops the engine immediately after a full speed running of an associated watercraft and then restarts the engine a preset time later. When the engine is stopped, a temperature within the cowling increases by the heat of the engine under the stopped condition of the watercraft so that the fuel in each fuel passage of the respective conduits vaporizes. In particular, if a fuel that has a high lead vapor pressure is used, or the outboard motor is used under circumstances such that an air temperature or a water temperature is relatively high, an amount of the fuel that vaporizes can be larger.

When the fuel in the fuel passages vaporizes as discussed above, the vapor pushes the liquid fuel back to the main fuel tank. Consequently, the fuel passages can be nearly or completely depleted of liquid fuel. If the engine is started under the condition that only a nominal amount of the liquid fuel is in the fuel passages in the low pressure fuel supply system, all of the fuel in the vapor separator tank may be consumed before the fuel in the main fuel tank is supplied to the vapor separator tank by the low pressure fuel pump. As a result, the engine can stall.

Thus, in the conventional fuel supply device, if the performs a "dead soak", the operator needs to supply the fuel to the low pressure fuel supply system using the manually operated primer pump prior to restarting of the engine as described above. This operation of the primer pump can be a burden for the operator because the operator repeatedly grasps and releases a pressurizing portion made of a rubber material by hand.

In addition, the primer pump is used when, other than the dead soak type operation, the main fuel tank is replenished with another amount of fuel after the engine completely consumed the fuel in the main fuel tank. This operation of the primer pump can be a similar burden to the operator.

Thus, in accordance with an embodiment, a fuel supply device for an outboard motor, wherein a low pressure fuel pump supplies fuel to a vapor separator tank positioned adjacent to an engine from a main fuel tank disposed in a hull of an associated boat can be provided. The fuel supply device can comprise an electrically operated primary fuel pump and a check valve both positioned parallel to each other and between the main fuel tank and the low pressure fuel pump. Additionally, a control device can be connected to the primary fuel pump for operating the primary fuel pump only for a preset fuel supply time when the engine is started.

In accordance with another embodiment, an outboard motor can comprise an engine, a cowling disposed over the engine, and a vapor separator tank disposed between the engine and the cowling. A low pressure fuel pump can be configured to supply fuel from a main fuel tank carried by a boat to which the outboard motor is mounted to the vapor separator tank. An electrically operated primary fuel pump and a check valve can both be positioned parallel to each other and between the main fuel tank and the low pressure fuel pump. A control device can be connected to the primary fuel pump and configured to operate the primary fuel pump to pump fuel from the main fuel tank to the vapor separator for a preset time and to prevent the engine from starting for a predetermined time when an operator is attempting to start the engine.

In accordance with yet another embodiment, an outboard motor can comprise an engine, a cowling disposed over the engine, and a vapor separator tank disposed between the engine and the cowling. A low pressure fuel pump can be configured to supply fuel from a main fuel tank carried by a boat to which the outboard motor is mounted to the vapor separator tank. An electrically operated primary fuel pump and a check valve can both be positioned parallel to each other and between the main fuel tank and the low pressure fuel pump. Additionally, means can be provided for automatically operating the primary fuel pump to pump fuel from the main fuel tank to the vapor separator for a preset time and to prevent the engine from starting for a predetermined time when an operator is attempting to start the engine.

BRIEF DESCRIPTION OF THE DRAWINGS

These and other features and advantages of the inventions will become more apparent upon reading the following detailed description and with reference to the accompanying drawings of embodiments that exemplify the inventions, in which.

DETAILED DESCRIPTION OF THE PREFERRED EMBODIMENT

Figure 1:
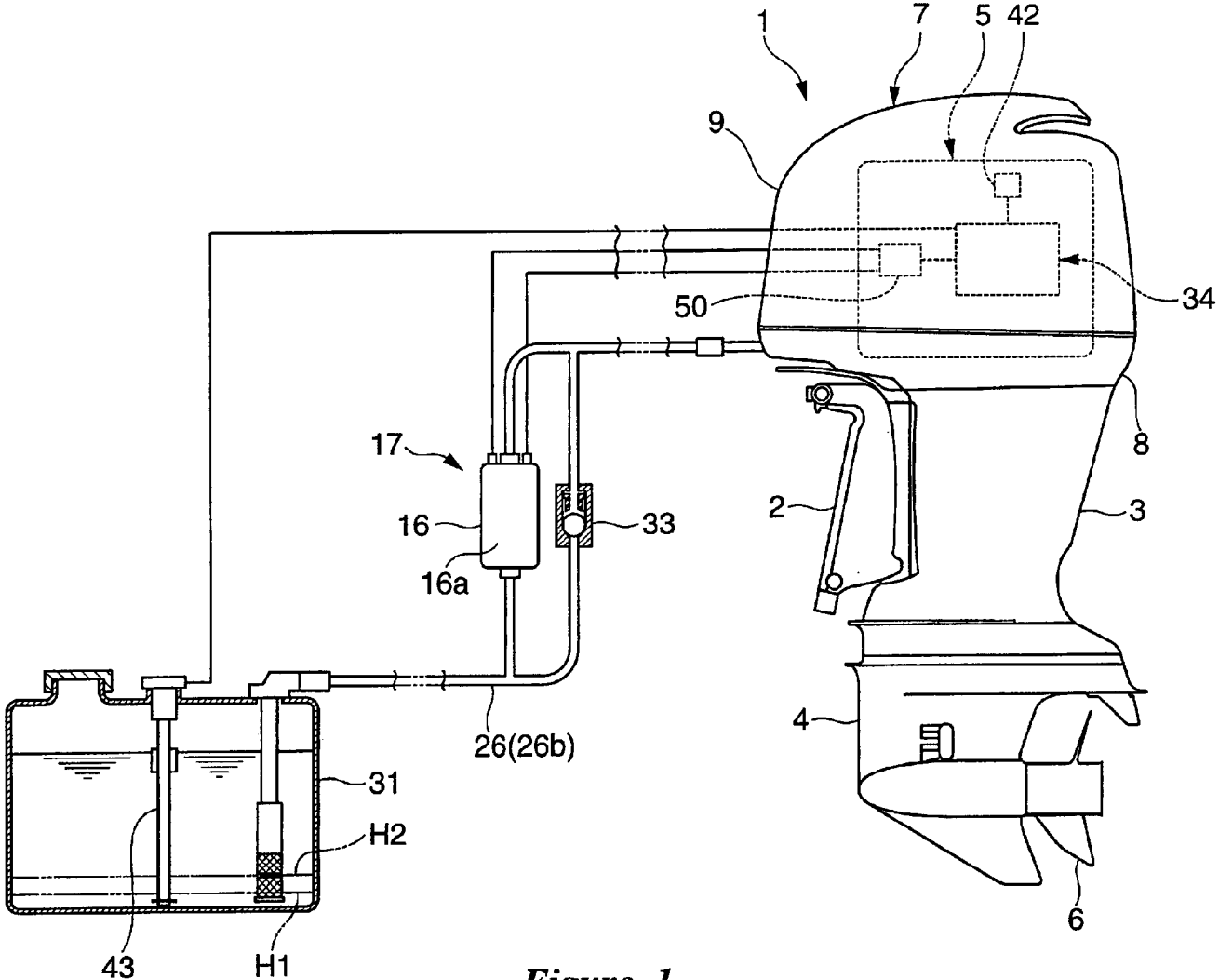
FIG. 1 is a schematic side elevational view of a fuel supply device of an outboard motor according to an embodiment.

FIG. 1 is a schematic side elevational view of an outboard motor 1 including a fuel supply system according to an embodiment. The inventions disclosed herein are disclosed in the context of outboard motors because these inventions have particular utility in this context. However, the inventions disclosed herein can also be used in other contexts, including fuel systems for other types of engines used to power other types of vehicles and other types of machines.

The outboard motor 1 can include a clamping bracket 2 for mounting it to a transom of an associated hull (not shown). The outboard motor 1 can also include an upper casing 3 and a lower casing 4 both supported by the clamping bracket 2, an engine 5 disposed above the upper casing 3, a propeller 6 rotated by the power from the engine 5, and a cowling 7 that encloses the engine 5 and so forth.

The cowling 7 can include a bottom cowling 8 formed generally in the shape of a shallow tray that opens upwardly and is coupled with an upper portion of the upper casing 3. A top cowling 9 can be used to close the opening defined at the upper end of the bottom cowling 8.

Figure 2:
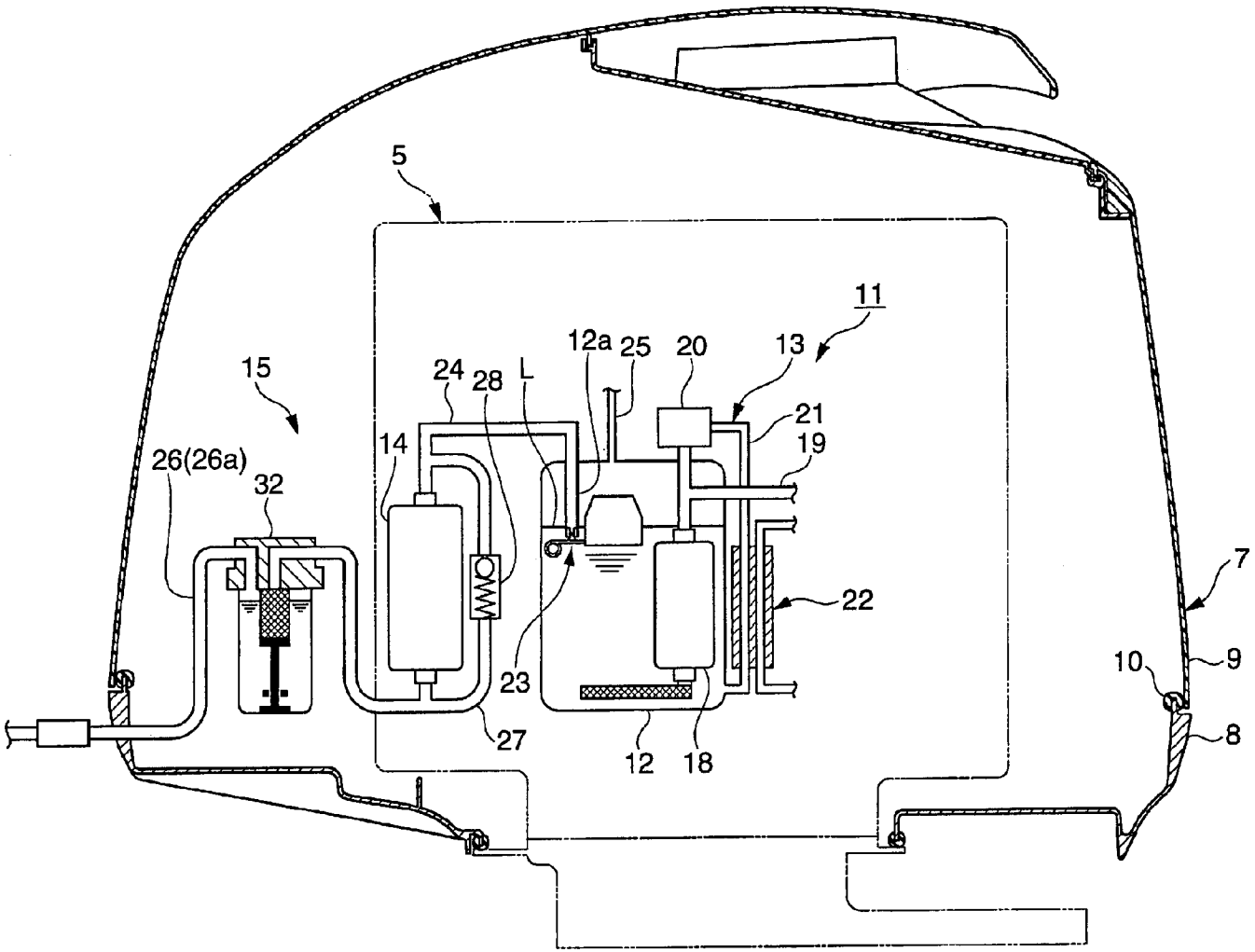
FIG. 2 is an enlarged cross sectional view of the powerhead of the outboard motor of FIG. 1, and showing a partial sectional and cutaway schematic view of a portion of the fuel supply system within the cowling of the powerhead of the outboard motor.

As shown in FIG. 2, a seal member 10 can be watertightly inserted between the bottom cowling 8 and the top cowling 9. The bottom cowling 8 can be made of an aluminum alloy, while the top cowling 9 can be made of a synthetic resin.

As shown in FIG. 2, the engine 5 can have a fuel supply device 11 including fuel injectors (not shown). The fuel supply device 11 can also include a high pressure fuel supply system 13 having a vapor separator tank 12, a low pressure fuel supply system 15 having a low pressure pump 14, and an electrically operated primer pump 16 (see FIG. 1), which is described below. The electrically operated primer pump 16 can function as a primary fuel pump.

The high pressure fuel supply system 13 can comprise the vapor separator tank 12 positioned on a side of the engine 5, a high pressure fuel pump 18 placed within the vapor separator tank 12, the fuel injectors (not shown) connected to the high pressure pump 18 through high pressure fuel supply conduits 19, a pressure regulator 20 for regulating the fuel pressure in the high pressure fuel supply conduits 19 and so forth. However, other configurations and also be used. In some embodiments, a water-cooled fuel cooling unit 22 can be coupled with a portion of a fuel return conduit 21 connecting a downstream side of the pressure regulator 20 and an internal cavity of the vapor separator tank 12.

A float type switching valve 23 can be disposed in the cavity of the vapor separator 12 to close or release a bottom end opening of a fuel inlet port pipe 12*a*. The switching valve 23 can close the opening when a liquid surface L in the vapor separator tank 12 is positioned at the highest level shown in FIG. 2. The switching valve 23 can release the opening when the liquid surface L can be lowered from the highest level.

The fuel inlet port pipe 12*a* can be connected to a low pressure fuel pump 14, which is described below, through a downstream side low pressure fuel supply conduit 24. A pipe 25 can be coupled with a top end of the vapor separator tank 12 to guide vapor (fuel as) developed in the cavity of the vapor separator tank 12 to an intake passage of the engine.

The high pressure fuel pump 18 draws in the fuel accumulated in the cavity of the vapor separator tank 12 and discharges it to the high pressure fuel supply conduits 19. The components of the high pressure fuel supply system 13, including the high pressure fuel pump 18, can be positioned on a side of and adjacent to the engine 5 within the cowling 7, although other configurations can also be used.

The low pressure fuel pump 14 can be mounted on a side portion of the engine 5 by a support bracket, which is not shown. The low pressure fuel pump 14 can incorporate a drive motor (not shown) therein, and can be mounted on the engine 5 under a condition that an axis of a drive shaft positioned in the drive motor extends generally vertically. However, other orientations can also be used.

A top end of the low pressure fuel pump 14 has a fuel discharge port (not shown). The downstream side low pressure supply conduit 24 can be coupled with the fuel discharge port. Meanwhile, a bottom end of the low pressure fuel pump 14 has a fuel suction port (not shown). An upstream side low pressure fuel supply conduit 26, which will be described below, can be coupled with the fuel suction port. The low pressure fuel pump 14 has a bypass conduit 27 for connecting the fuel suction port and the fuel discharge port with each other. A relief valve 28 can be positioned midway of the bypass conduit 27.

The upstream side low pressure fuel supply conduit 26 connects the fuel suction port of the low pressure fuel pump 14 and a fuel outlet of the main fuel tank 31 of the hull side shown in FIG. 1 with each other. A portion 26*a* of the conduit 26 extending within the cowling 7 can have a fuel filter unit 32. As shown in FIG. 1, another portion 26*b* of the upstream side low pressure fuel supply conduit 26 extending to the main fuel tank 31 in the hull can have an electrically operated primer pump 16 and a check valve 33. The fuel filter unit 32 can be mounted on the engine 5 similarly to the low pressure fuel pump 14, although this mounting arrangement is not shown.

The primer pump 16 can have almost the same construction as the low pressure fuel pump 14, and can be mounted on the hull by a support bracket (not shown). The primer pump 16 and the check valve 33 can be connected to the upstream side low pressure fuel supply conduit 26 so that they extend parallel to each other.

The check valve 33 can be configured to only allow the fuel to flow to the outboard motor 1 side from the main fuel tank 31, and can be mounted on the hull similarly to the primer pump 16. In this fuel supply device 11, the primer pump 16 does not function while the engine 5 operates. Thus, under this condition, the fuel supplied to the outboard motor 1 side from the main fuel tank 31 inevitably passes through the check valve 33.

Figure 3:
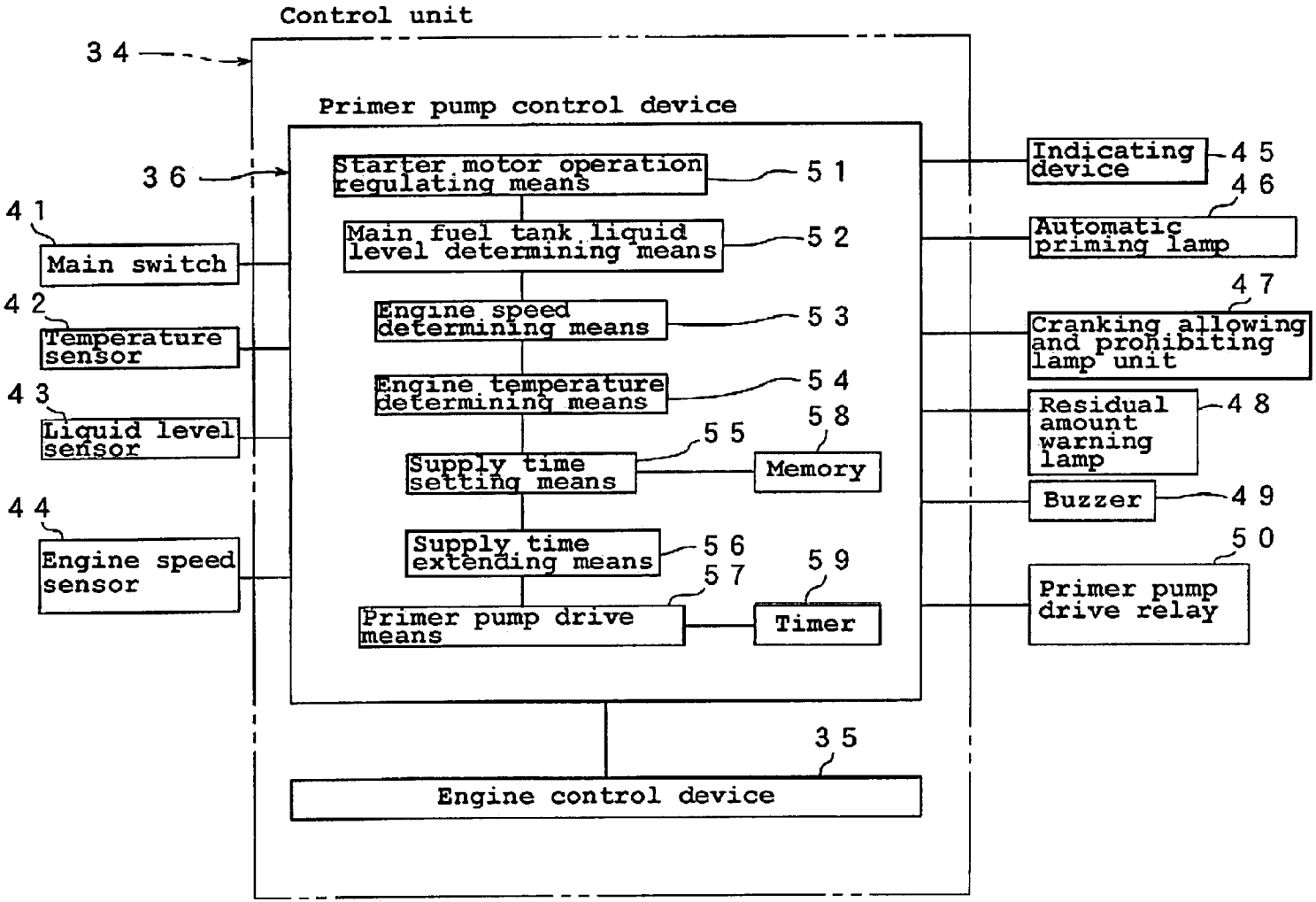
FIG. 3 is a block diagram of the fuel supply system.

A drive motor (not shown) housed in a housing 16*a* of the primer pump 16 can be connected to a control unit 34 (see FIG. 1) disposed in the outboard motor 1. As shown in FIG. 3, the control unit 34 can include an engine control device 35 configured to control the starting and stopping of the engine 5, fuel injection amounts and the like, and a primer pump control device 36 for controlling the operation of the primer pump 16. Although the control device 35 can also be configured to control other operations as well. The engine control device 35 can have the same general construction used for the control devices used for conventional outboard motors, for example, it can include at least one memory device, at least one processor, etc, configured to perform typical outboard motor control operations. In some embodiments, such a controller can also be in the form of a hard-wired control device.

In some embodiments, as shown in FIG. 3, a main switch 41, a temperature sensor 42, a liquid level sensor 43 and an engine speed sensor 44 can be connected to an input side of the primer pump control device 36. The main switch 41 can be located in an area of the cockpit of the hull, and can be operable, for example, between two positions. That is, when the main switch 41 is operated to be at the first position, a feed circuit of the control unit 34 can be activated, and simultaneously a control operation for the primer pump control device 36, which is described below, can be started. Meanwhile, when the main switch 41 is changed to the second position beyond the first position, a starter motor (not shown) can start the engine 5. In some embodiments, the engine 5 will not start until a preparation for the start operation has been finished by the primer pump control device 36.

Various kinds of temperature sensors normally used for conventional outboard motors can be used as the temperature sensor 42. The temperature sensor 42 can be formed with any one of, or with a combination of a plurality of sensors selected from an engine temperature sensor for detecting a temperature of an outer wall of the engine 5, an oil temperature sensor for detecting a temperature of lubricant oil, a water temperature sensor for detecting a temperature of cooling water, an intake air temperature sensor for detecting intake air in the intake passage or the like. Other types of sensors can also be used to provide a temperature signal indicative of the temperature of the engine 5.

As shown in FIG. 1, the liquid level sensor 43 can be configured to detect a level of the fuel in the main fuel tank 31. The engine speed sensor 44 can be configured to detect an engine speed based upon a rotation of a crankshaft (not shown), number of ignition times of an ignition system, or the like.

As shown in FIG. 3, an indicating device 45, automatic priming lamp 46, a cranking allowing and prohibiting lamp unit 47, a residual amount warning lamp 48, a buzzer 49 and a primer pump drive relay 50 can be connected to an output side of the primer pump control device 36. The indicating device 45, all of the lamps and the buzzer 49 can be disposed in the cockpit of the hull, or anywhere in the hull where an operator of the associated boat can see them. The primer pump drive relay 50 can be configured to switch a power supply circuit for the primer pump 16.

As shown in FIG. 3, the primer pump control device 36 can have a starter motor operation regulating means 51, main tank liquid level determining means 52, engine speed determining means 53, engine temperature determining means 54, supply time setting means 55, supply time extending means 56, primer pump drive means 57, a memory 58, a timer 59 and so forth. However, other components can also be included.

The starter motor operation regulating means 51 can be connected to the engine control device 35, and can be configured to regulate the operation of the starter motor, which is not shown. The main tank liquid level determining means 52 can be configured to determine whether an actual level of the fuel in the main fuel tank 31 detected by the liquid level sensor 43 can be lower than a preset warning level H2 (see FIG. 1) or not, and also to determine whether the actual level is lower than the minimum level H1 (see FIG. 1) or not. In addition, the main tank liquid level determining means 52 can be configured to reach the determination that the main fuel tank 31 is empty if the actual level of the fuel is lower than the minimum level H1 and to store this empty determination result into the memory 58.

The engine speed determining means 53 can be configured to determine whether an engine speed Ne detected by the engine speed sensor 44 is zero or not, and also to determine whether the engine speed Ne is greater than a preset start determining speed nc or not.

The engine temperature determining means 54 can be configured to determine whether a temperature of the engine 5 detected by the temperature sensor 42 is greater than a warming up condition determining temperature Tc or not.

The supply time setting means 55 can be configured to compute a time (predetermined operation time) for which the primer pump 16 operates, by putting the temperature of the engine 5 detected by the temperature sensor 42 into a predetermined function used for the dead soak operation.

The supply time extending means 56 can be configured to exchange the function for the dead soak operation to another function which is different from the function for the dead soak operation if the main fuel tank liquid level determining means 52 determines that the main fuel tank 31 is empty. The function used when the empty determination is made is used to trigger a mode in which the time for which the primer pump 16 operates is extended.

The primer pump drive means 57 can be configured to place the primer pump drive relay 50 in an ON condition for the desired operation time set by the supply time setting means 55 to operate the primer pump 16 during the time.

With reference to FIGS. 4–7, an operation of the primer pump control device 36 is described in detail together with more detailed descriptions of the structure thereof.

Figure 4:
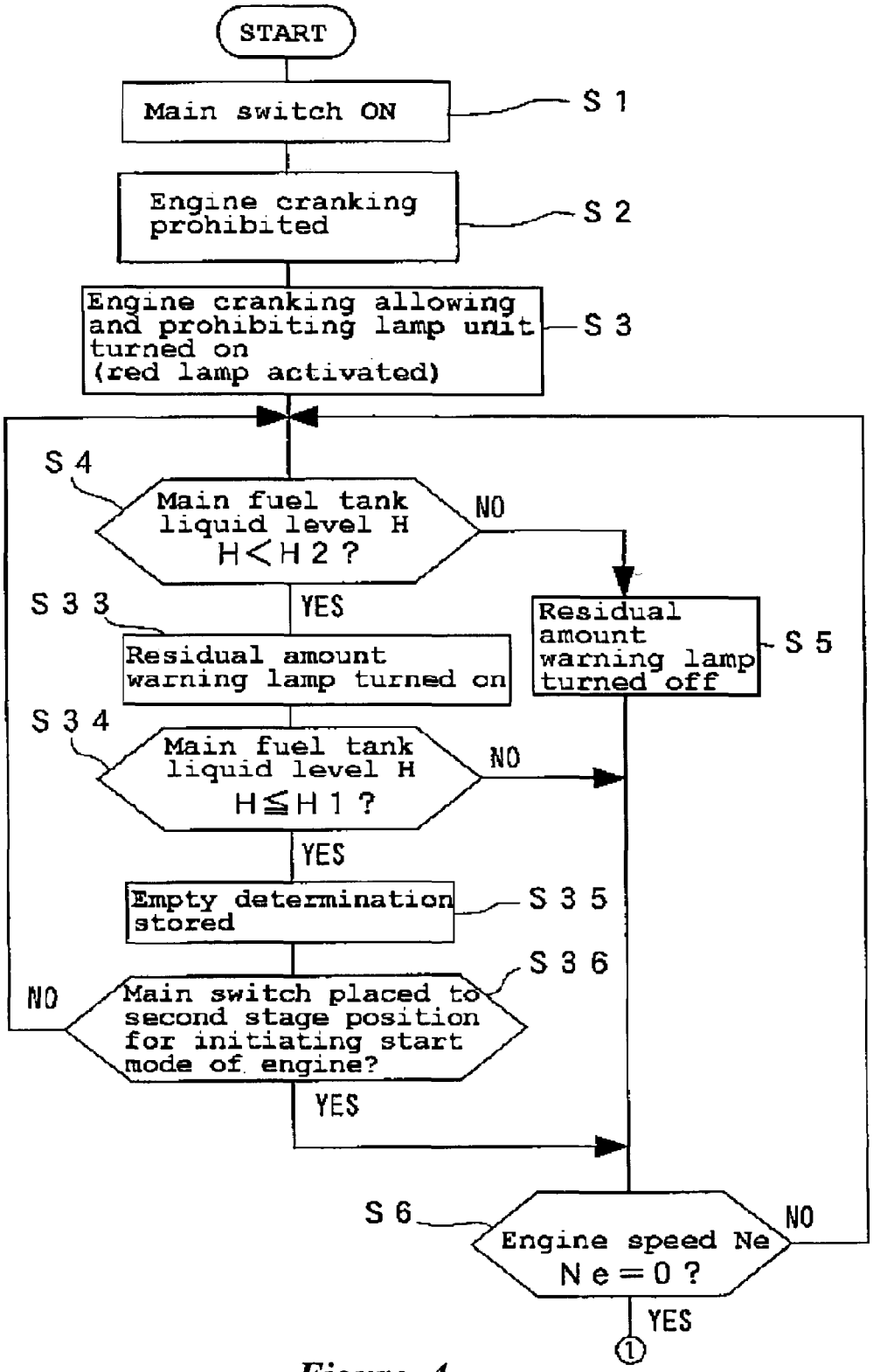
FIG. 4 is a portion of a flowchart of a method of operating a fuel supply system that can be used with the fuel supply system illustrated in FIGS. 1–3.

As shown in FIG. 4, upon setting the main switch 41 to the first position and at a step S1, the primer pump control device 36 can start its operation. In this operation, the primer pump control device 36 can regulate the engine control device 35 to prohibit the starter motor from starting the engine at a step S2 while the main switch 41 stays at the first stage position. At a step S3, the control device 36 can turn on a red lamp of the cranking allowing and prohibiting lamp unit 47 which indicates the prohibition of the engine start to the operator. Thus, the engine will not start during this mode of operation.

Next, at a step S4, the main fuel tank liquid level determining means 52 of the control device 36 can determine whether a liquid level H at this moment in the main fuel tank 31 is lower than the warning level H2 or not. If a sufficient amount of the fuel is present in the main fuel tank 31, the control device 36 determines "NO" at a step 4, and turns off the residual amount warning lamp 48 at a next step S5 if it was already on.

Afterwards, at a step S6, the engine speed determining means 53 determines whether an engine speed Ne at this moment is zero or not. In this determination, if the engine 5 has already been operating, the control device 36 returns to the step S4. If the engine 5 is not running (e.g., the crankshaft of the engine 5 is not rotating), the control device 36 goes to a step S7 of the flowchart of FIG. 5. This is because the primer pump 16 is only operated, in some embodiments, under a condition that the engine 5 is not running.

At the step S7, the main fuel tank liquid level determining means 52 can determine whether the means 52 have ever determined that the main fuel tank 31 is empty. If the main fuel tank 31 has a sufficient amount of the fuel, the means 52 determines "NO" and the control device 36 goes to a step S8.

The engine temperature determining means 54, at the step S8, can determine whether a temperature T of the engine 5 at this moment is higher than the warming up condition determining temperature Tc or not. If the temperature T of the engine 5 is lower than the warming up condition determining temperature Tc, the engine 5 is started without the primer pump 16 being used. The control device 36 allows itself to go to a step S9 only when the temperature T of the engine 5 is higher than the warming up condition determining temperature Tc.

At the step S9, the supply time setting means 55 set the desired operation time tp of the primer pump 16. The desired (e.g., a predetermined time) operation time tp at this moment is equal to a time th that is computed by putting the detected engine temperature T into the predetermined function for the dead soak operation.

After the predetermined operation time tp is set as discussed, the primer pump drive means 57 operates the primer pump 16 for this predetermined operation time tp at steps S10–S13. In the event of that the primer pump 16 does not change to the ON condition, the control device 36 goes to a step. S14 from the step S11 to make the indicating device 45 show a message regarding this abnormal state and also to stop the entire control from that time onward. If the primer pump 16 changes to the ON condition, the primer pump drive means 57, at the step S12, turn the automatic priming lamp 46 on. The turned-on state of the automatic priming lamp 46 notifies the operator that the primer pump 16 is in operation.

Figure 6:
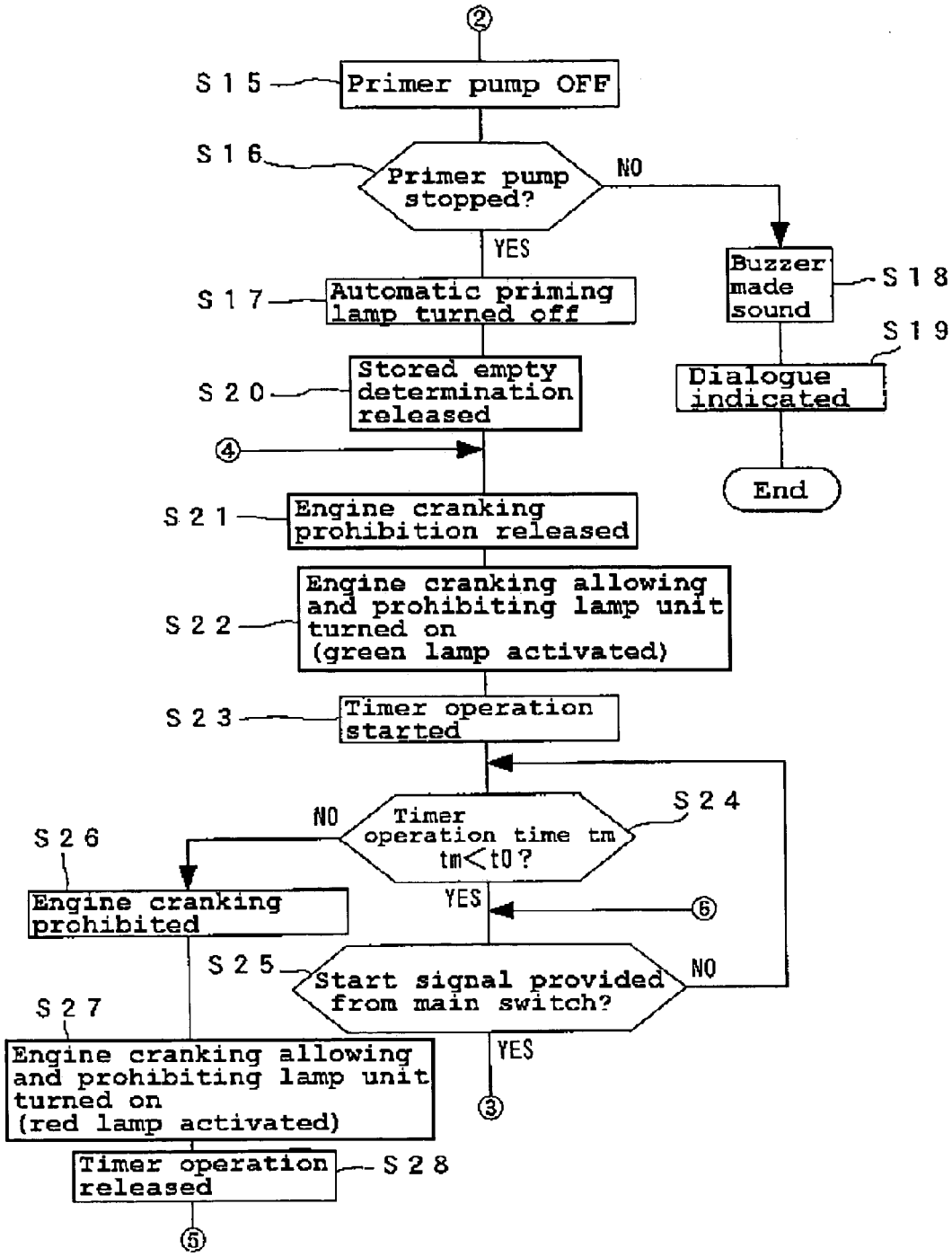
FIG. 6 is a further portion of the flowchart partially shown in FIGS. 4 and 5.

As shown in the flowchart of FIG. 6, after the primer pump 16 operates for the predetermined operation time tp, the primer pump drive means 57 stops the primer pump 16 at a step S15. The primer pump drive means 57 checks the standstill condition of the primer pump 16 (i.e., checks whether the primer pump is stopped) at a step S16, and then goes to a step S17 to turn the automatic priming lamp 46 off. In the event of that the primer pump drive means 57 is not able to confirm the standstill condition of the primer pump 16 at the step S16, the primer pump drive means 57 make the buzzer 49 sound at a step S18, make the indicating device 45 show a message regarding this abnormal state at a step S19, and also stop the entire control from that time onward.

After the primer pump 16 is stopped as thus described, if the main fuel tank liquid level determining means 52 has recorded in its memory an "empty determination", the means 52 purge the memory (e.g., erases the memory) at a step S20. The starter motor operation regulating means 51, at a step S21, place the starter motor under the condition that it is ready for operation. In addition, if the temperature T of the engine 5 is determined to be lower than the warming up condition determining temperature Tc at the step S8, the control device 36 directly jumps to the step S21.

After the engine 5 is allowed to be started at the step S21, the starter motor operation regulating means 51, at a step S22, turns on a green light of the cranking allowing and prohibiting lamp unit 47 to indicate that the operator is allowed to start the engine. At a step S23, the starter motor operation regulating means 51 make the timer 59 start clocking.

Afterwards, at steps S24 and S25, the starter motor operation regulating means 51 awaits a moment at which a time tm that the timer 59 counts reaches a preset determination time t0, or waits until the start operation of the starter motor is made by the main switch 41 (i.e., the main switch 41 is operated to the second stage position), respectively. Under these circumstances, if the starter motor is not operated in the determination time t0, the starter motor operation regulating means 51 again regulates the start operation of the starter motor at a step S26, turns the red lamp of the cranking allowing and prohibiting lamp unit 47 at a step S27, and stops the timer 59 at a step S28. Afterwards, the control device 36 returns to the step S8 and repeats the steps described above.

Figure 7:
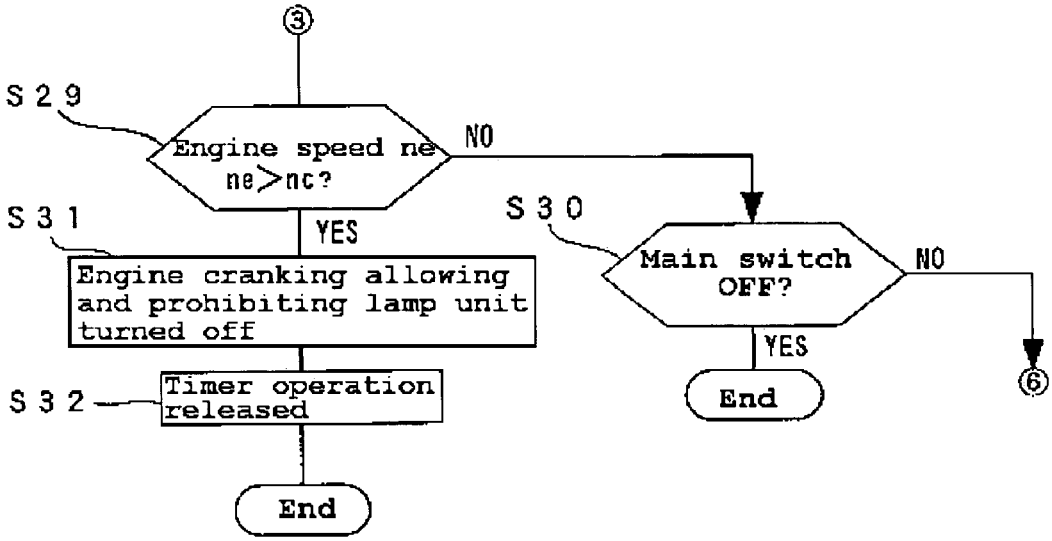
FIG. 7 is a still further portion of the flowchart partially shown in FIGS. 4 and 5.

On the other hand, if the start operation of the starter motor is made, the control device 36 goes to a step S29 of the flowchart of FIG. 7 so that the engine speed determining means 53 determines whether an engine speed ne at this moment is greater than the start determining speed nc. If the engine 5 is not started, the control device 36 determines at a step S30 whether the main switch 41 is placed under the OFF condition or not. If the OFF condition of the main switch 41 is determined, the entire control from that time onward is stopped. Under the condition that the main switch 41 is operated to the first position, the control device 36 returns to the step S25 to wait for the start operation by the starter motor.

If it is determined at the step S29 that the engine 5 has been started, the starter motor operation regulating means 51 turns off all the lamps of the cranking allowing and prohibiting lamp unit 47 at a step S31, stops the timer 59 at a step 32, and then stops the entire control from that time onward. That is, in the dead soak operation, the fuel supply device 11 of this embodiment operates the primer pump 16 for the time corresponding to the temperature T of the engine 5 to supply the fuel in the main fuel tank 31 to the outboard motor 1 side when the engine is started.

If the fuel in the main fuel tank 31 is consumed and the level of the fuel is lowered to the warning level H2, the control device 36 determines "YES" at the step S4 of the flowchart of FIG. 4. Under this condition, at a step S33, the main fuel tank liquid level determining means 52 turns the residual amount warning lamp 48 on, and determines at a step S34 whether a level of the fuel in the main fuel tank 31 at this moment is lower than the minimum level H1.

If the level of the fuel is higher than the minimum level H1, the liquid level determining means 52 determine "NO" and the control device 36 goes to a step S6. Meanwhile, if the level of the fuel is lower than the minimum level H1, the main fuel tank liquid level determining means 52, at the step S35, stores the determination result that the main fuel tank 31 is empty into the memory 58. In addition, at a step S36, the starter motor operation regulating means 51 determines whether the start operation of the starter motor is made by the main switch 41 or not.

If the determination is "NO," the control device 36 returns to the step S4. Meanwhile, if the determination is "YES," the control device 36 goes to the step S6.

Figure 5:
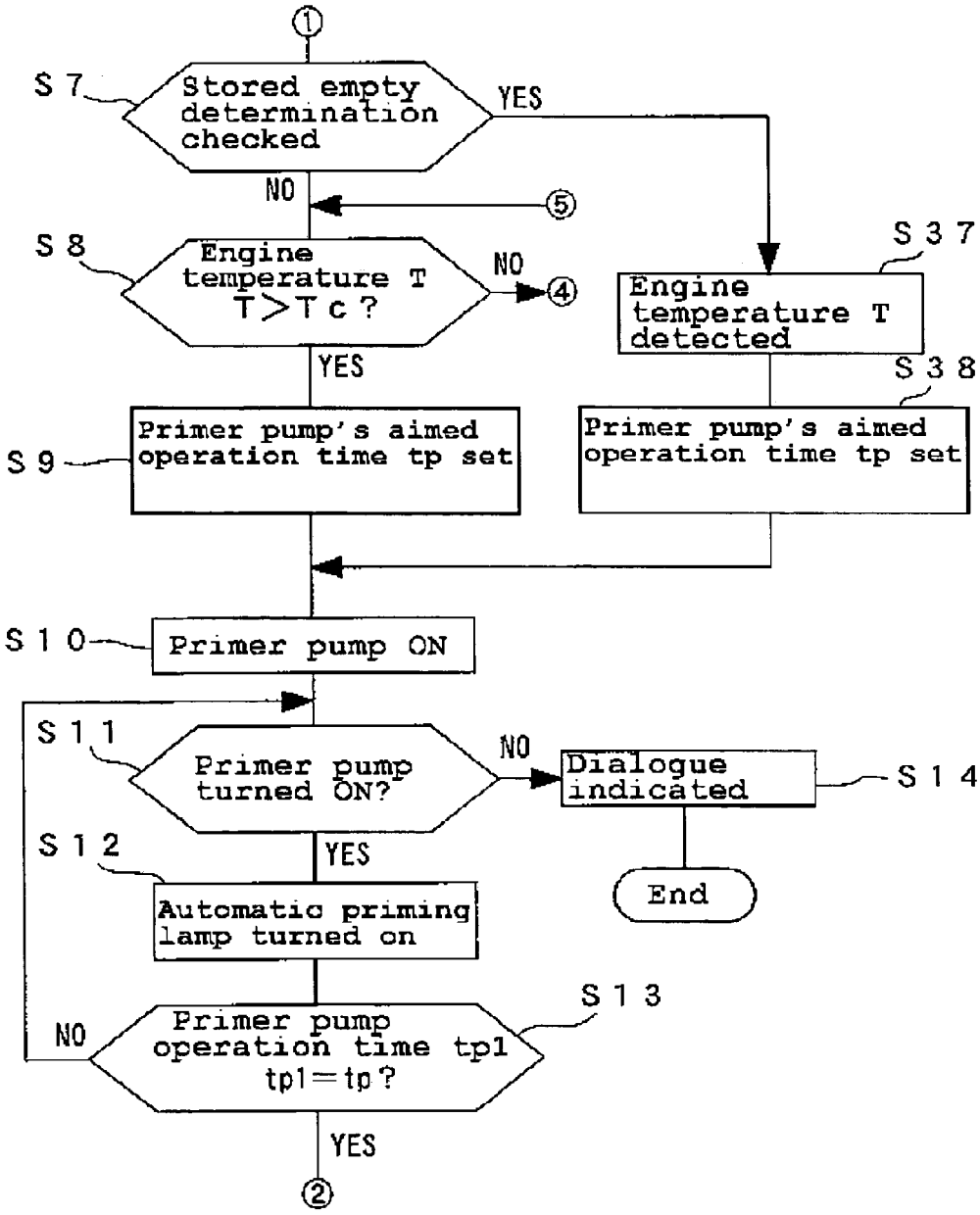
FIG. 5 is another portion of the flowchart partially shown in FIG. 4.

Afterwards, the control device 36 goes to the step S7 of the flowchart of FIG. 5 only when the engine speed Ne is zero. The control device 36 determines "YES" at the step S7 and then goes to a step S37.

At the step S37, the engine temperature determining means 54 detect a temperature T of the engine at this moment. Next, at a step S38, the supply time setting means 55 sets a predetermined operation time tp of the primer pump 16 based upon the engine temperature T. The predetermined operation time tp under this condition is set to the time tc computed by putting the engine temperature T at this moment into the function for the predetermined empty determining operation. The predetermined operation time tp at this moment is greater than the predetermined operation time for the dead soak operation.

After the predetermined operation time tp is set as discussed above, the control device 36 goes to the step S10 and repeats the steps described above.

As thus described, according to the fuel supply device 11 for the outboard motor 1 in this embodiment, the electrically operated primer pump 16 supplies the fuel to the outboard motor 1 side from the main fuel tank 31 prior to the start of the engine 5. The vapor in the fuel passages of the low pressure fuel supply system 15 thus is moved to the vapor separator tank 12 so that the fuel passages thereof are filled with the liquid fuel. Therefore, in the outboard motor 1 having the fuel supply device 11 of this embodiment, the low pressure fuel pump 14 can supply the fuel to the internal cavity of the vapor separator tank 12 immediately after the start of the engine 5.

In the fuel supply device 11 of this embodiment, the fuel supply amount of the primer pump 16 varies in accordance with the temperature T of the engine 5. Because the amount of the vapor developed in the dead soak operation increases in accordance with the temperature T of the engine 5, an sufficient amount of the fuel can be supplied to the outboard motor 1 using the fuel supply device 11 of this embodiment.

In the fuel supply device 11 of this embodiment, the operation time of the primer pump 16 is extended (i.e. is made longer) if the residual amount of the fuel in the main fuel tank 31 is less than the minimum amount. Thus, under such a condition that the residual amount of the fuel in the main fuel tank 31 becomes small and the air is more likely to be sucked into the fuel passages extending between the main fuel tank 31 and the vapor separator tank 12, the fuel can be sufficiently supplied to the fuel passages prior to the start of the engine 5.

In the fuel supply device 11 of this embodiment, the residual amount warning lamp 48 is turned on when the level of the fuel in the main fuel tank 31 reaches the warning level H2. The warning lamp 48 thus can urge the operator to replenish the main fuel tank 31 with the fuel.

In the fuel supply device 11 of this embodiment, the fuel supply process by the primer pump 16 can be omitted when the temperature T of the engine 5 at the moment of its start is lower than the warming up condition determining temperature Tc. Thereby, the engine 5 can be quickly started.

In the fuel supply device 11 of this embodiment, if the engine 5 is not started within a predetermined time since the primer pump 16 supplied the fuel to the outboard motor 1 side, the primer pump 16 again supplies the fuel in the next start operation of the engine. Therefore, even though the temperature of the interior of the cowling 7 is high, the fuel passages can be filled with the liquid fuel all the time.

Figure 8:
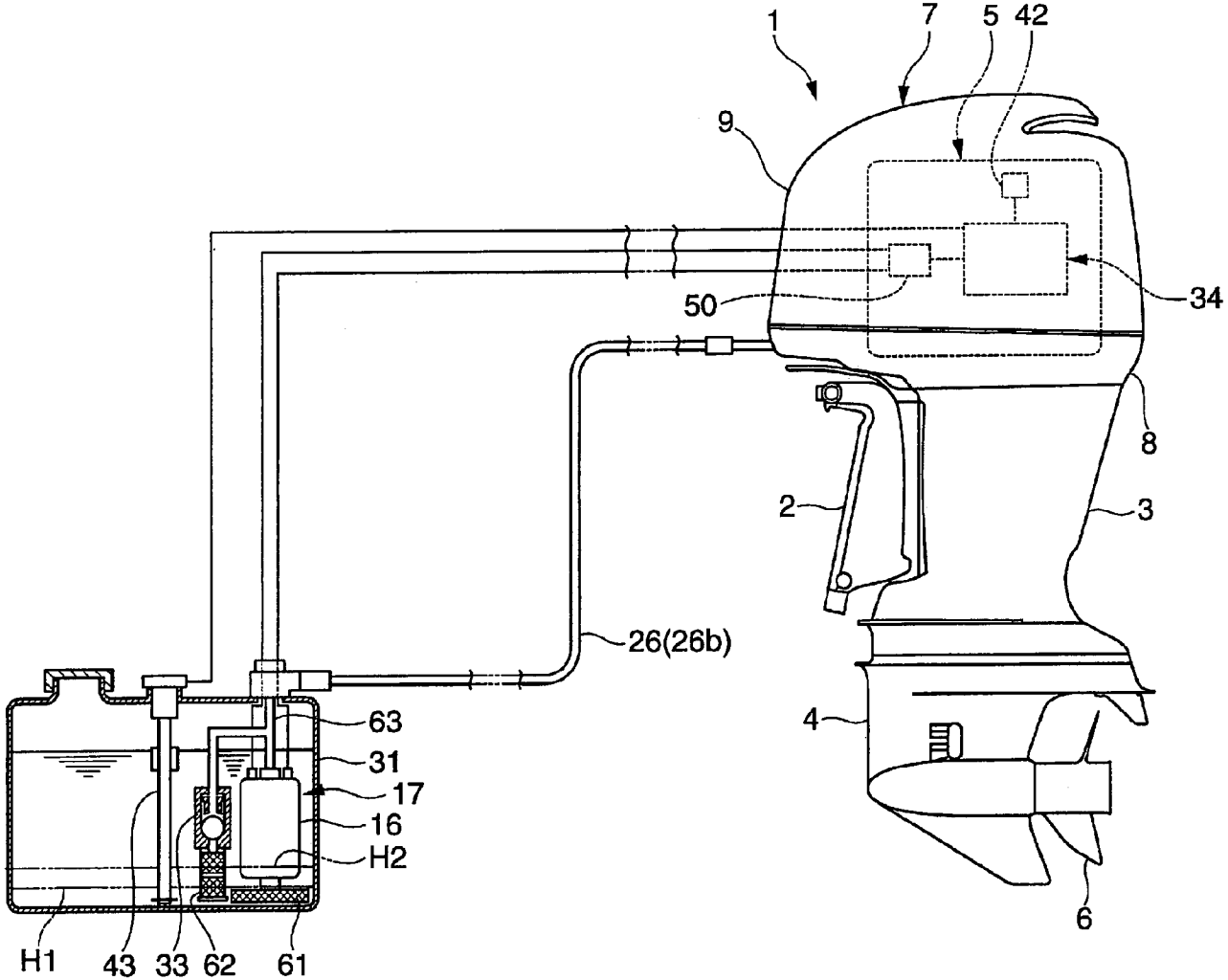
FIG. 8 is a schematic side elevational view of an outboard motor including a modification to the fuel system shown in FIG. 1.

FIG. 8 illustrates a modification of the fuel supply device described above. In FIG. 8, the same or similar members as or to the members described referring to FIGS. 1–7 are assigned with the same reference numerals or symbols, and detailed descriptions of those members will not be repeated as appropriate.

The electrically operated primer pump 16 and the check valve 33 can together be positioned within the main fuel tank 31 of FIG. 8 under a condition that both members 16, 33 are immersed in the fuel. A bottom end (a portion for fuel suction) of the primer pump 16 and a bottom end of the check valve 33 both can have respective strainers 61, 62.

A top end of the primer pump 16 and a top end of the check valve 33 can be connected to each other through a connecting pipe 63 that extends generally vertically in the main fuel tank 31. A downstream end of the connecting pipe 63 can be coupled with the upstream side low pressure fuel supply conduit 26. Although other configurations can also be used.

Because of the construction in this embodiment, the main fuel tank 31 and the outboard motor 1 can be connected to each other through a single upstream side low pressure fuel supply conduit 26. The fuel supply device 11 according to this embodiment thus can have a simpler structure of the fuel conduits in the hull. Also, because the main fuel tank 31 is the component that supports the primer pump 16 and the check valve 33, no other support bracket is necessary to support the primer pump 16 and the check valve 33 on the hull side.

Figure 9:
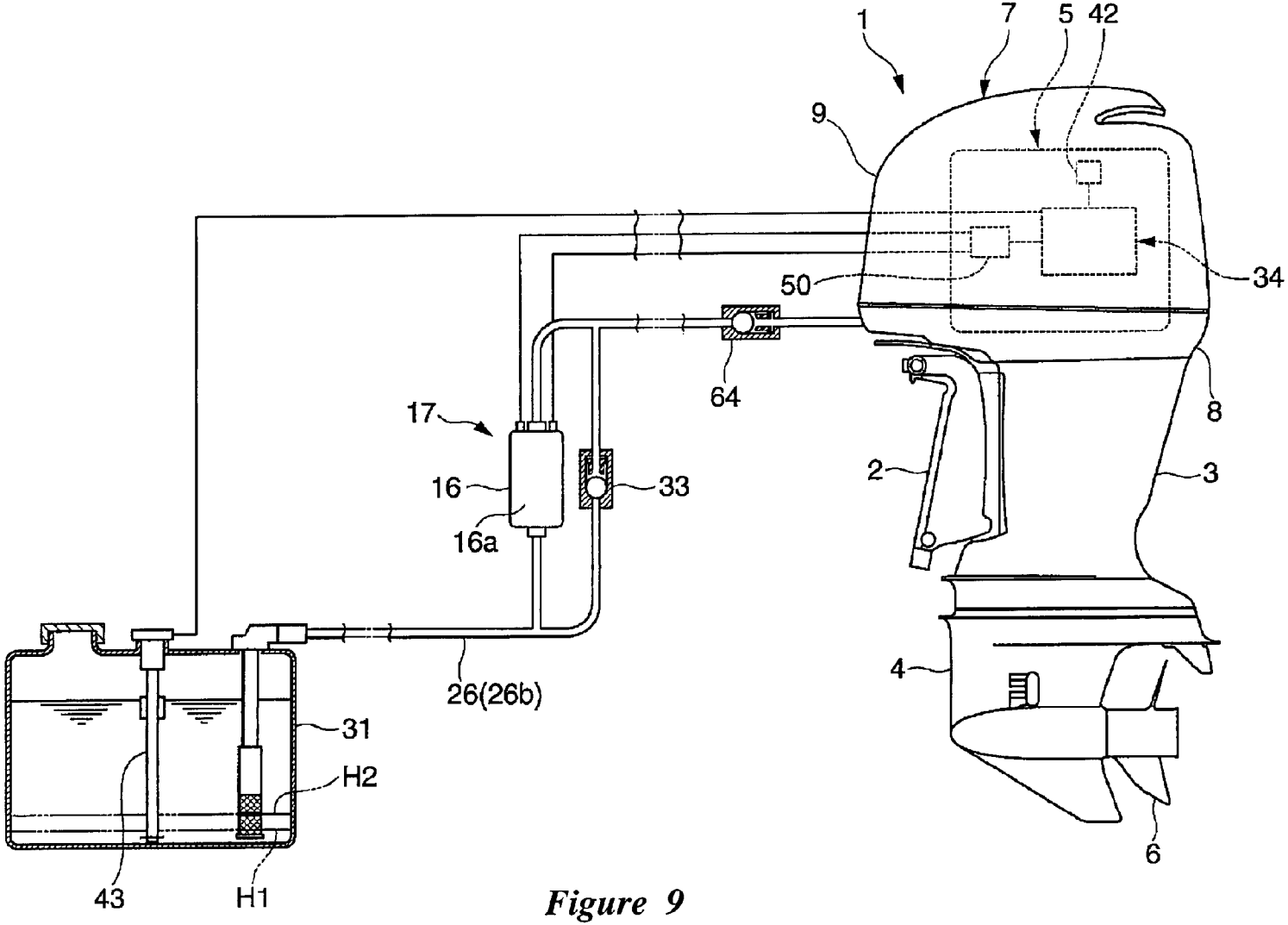
FIG. 9 is a schematic side elevational view of an outboard motor including yet another modification to the fuel system shown in FIG. 1.

FIG. 9 illustrates yet another modification of the fuel supply devices described above. In FIG. 9, the same or similar members as or to the members described referring to FIGS. 1–7 are assigned with the same reference numerals or symbols, and detailed descriptions of those members will not be repeated as appropriate.

The upstream side low pressure fuel supply conduit 26 of FIG. 9 can include another check valve 64 positioned between the primary fuel supply system 17, which can be formed with the primer pump 16 and the check valve 33, and the low pressure fuel pump 14. The check valve 64 only allows the fuel to flow to the outboard motor 1 side from the primary fuel supply system 17.

Because of the construction in this embodiment, the check valve 64 can prevent the fuel from returning back to the main fuel tank 31 through the primer pump 16 from the outboard motor 1. The primer pump 16 thus can be filled with the fuel all the time. Therefore, the primer pump 16 can transfer the fuel to the outboard motor 1 side at the same moment as the start of its operation. That is, the primer pump 16 can certainly transfer the fuel to the outboard motor 1 prior to the start of the engine 5.

It is to be noted that the functions performed by the components of the engine control unit 34, including the functions performed in any of the steps identified in the processes illustrated in FIGS. 4–7, and any data and/or maps used therewith can be referred to as "modules." In the embodiments disclosed above, such modules can be in the form data tables or executable programs, routines or subroutines stored and/or run in the engine control unit 34, or other devices.

It is to be noted that these modules, individually, collectively, or in various groupings, can be in the form of hard-wired feedback control circuits. Alternatively, these modules can be constructed of a dedicated processor and a memory for storing a computer program configured to perform the steps of the processes of FIGS. 4–7 or other processes with reference to data tables or maps of other modules. Additionally, these modules can be constructed of a general purpose computer having a general purpose processor and the memory for storing a computer program for performing the steps of the processes of FIGS. 4–7 or other processes with reference to data tables or maps of other modules.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A fuel supply device for an outboard motor, wherein a low pressure fuel pump supplies fuel to a vapor separator tank positioned adjacent to an engine from a main fuel tank disposed in a hull of an associated boat, the fuel supply device comprising an electrically operated primary fuel pump and a check valve both positioned parallel to each other and between the main fuel tank and the low pressure fuel pump, and further a control device connected to the primary fuel pump for operating the primary fuel pump only for a preset fuel supply time when the engine is started.

2. The fuel supply device for an outboard motor according to claim 1, wherein the primary fuel pump and the check valve are positioned within the main fuel tank.

3. The fuel supply device for an outboard motor according to claim 1, wherein a second check valve is positioned between the low pressure fuel pump and a primary fuel supply system including the primary fuel pump and the first check valve.

4. The fuel supply device for an outboard motor according to claim 2, wherein a second check valve is positioned between the low pressure fuel pump and a primary fuel supply system including the primary fuel pump and the first check valve.

5. The fuel supply device for an outboard motor according to claim 1 further comprising supply time setting means for setting the fuel supply time of the primary fuel pump in accordance with a temperature of the engine.

6. The fuel supply device for an outboard motor according to claim 2 further comprising supply time setting means for setting the fuel supply time of the primary fuel pump in accordance with a temperature of the engine.

7. The fuel supply device for an outboard motor according to claim 3 further comprising supply time setting means for setting the fuel supply time of the primary fuel pump in accordance with a temperature of the engine.

8. The fuel supply device for an outboard motor according to claim 5 further comprising a sensor for detecting a residual amount of the fuel in the main fuel tank, and supply time extending means for relatively extending the fuel supply time set by the supply time setting means when the residual amount of the fuel detected by the sensor is lower than the preset minimum amount.

9. An outboard motor comprising an engine, a cowling disposed over the engine, a vapor separator tank disposed between the engine and the cowling, a low pressure fuel pump configured to supply fuel from a main fuel tank carried by a boat to which the outboard motor is mounted to the vapor separator tank, an electrically operated primary fuel pump and a check valve both positioned parallel to each other and between the main fuel tank and the low pressure fuel pump, and a control device connected to the primary fuel pump and configured to operate the primary fuel pump to pump fuel from the main fuel tank to the vapor separator for a preset time and to prevent the engine from starting for a predetermined time when an operator is attempting to start the engine.

10. The outboard motor according to claim 9, wherein the control device is configured to extend the preset time in accordance with a temperature of the engine.

11. The outboard motor according to claim 9 additionally comprising a main switch for controlling operation of the outboard motor, the main switch being moveable between at least first and second positions, the main switch being further configured to activate a main power supply to at least the control device when the main switch is in the first position and to signal for activation of a starter motor when the switch is moved to the second position.

12. The outboard motor according to claim 9, wherein the control device is configured to prevent the starter motor from being activated when the main switch is in the second position, for the predetermined time.

13. An outboard motor comprising an engine, a cowling disposed over the engine, a vapor separator tank disposed between the engine and the cowling, a low pressure fuel pump configured to supply fuel from a main fuel tank carried by a boat to which the outboard motor is mounted to the vapor separator tank, an electrically operated primary fuel pump and a check valve both positioned parallel to each other and between the main fuel tank and the low pressure fuel pump, and a means for automatically operating the primary fuel pump to pump fuel from the main fuel tank to the vapor separator for a preset time and to prevent the engine from starting for a predetermined time when an operator is attempting to start the engine.

* * * * *

UNITED STATES PATENT AND TRADEMARK OFFICE

CERTIFICATE OF CORRECTION

PATENT NO. : 7,216,614 B2
APPLICATION NO. : 11/228559
DATED : May 15, 2007
INVENTOR(S) : Yasuhiko Shibata et al.

It is certified that error appears in the above-identified patent and that said Letters Patent is hereby corrected as shown below:

In Column 4, Line 41 (Approx.), please delete "as)" and insert -- gas) --, therefor.

In Column 7, Line 60, please delete "step." and insert -- step --, therefor.

Signed and Sealed this

Fourth Day of May, 2010

David J. Kappos

David J. Kappos
*Director of the United States Patent and Trademark Office*